US006935996B2

(12) United States Patent
Stern

(10) Patent No.: US 6,935,996 B2
(45) Date of Patent: Aug. 30, 2005

(54) DRINK POUCHES AND METHODS FOR PRODUCING THEM

(75) Inventor: Ran Stern, Kibbutz Sde-Yoav (IL)

(73) Assignee: C.L.P. Industries Ltd., M. P. Sde-Gat (IL)

( * ) Notice: Subject to any disclaimer, the term of this patent is extended or adjusted under 35 U.S.C. 154(b) by 0 days.

(21) Appl. No.: 09/926,736

(22) PCT Filed: Apr. 12, 2001

(86) PCT No.: PCT/IL01/00338

§ 371 (c)(1),
(2), (4) Date: Dec. 11, 2001

(87) PCT Pub. No.: WO01/76862

PCT Pub. Date: Oct. 18, 2001

(65) Prior Publication Data

US 2002/0137616 A1 Sep. 26, 2002

Related U.S. Application Data

(60) Provisional application No. 60/277,800, filed on Mar. 21, 2001, provisional application No. 60/261,903, filed on Jan. 16, 2001, and provisional application No. 60/196,355, filed on Apr. 12, 2000.

(51) Int. Cl.[7] ..... B31B 1/90; B65D 33/26; B65D 65/28

(52) U.S. Cl. ..... 493/212; 493/220; 493/228; 383/208

(58) Field of Search ..... 493/228, 240, 493/243, 269, 287, 374, 379, 344, 343, 355

(56) References Cited

U.S. PATENT DOCUMENTS 3,459,625 A 8/1969 Heller, Jr. et al.
3,626,143 A * 12/1971 Fry ..... 219/121.69
3,790,744 A * 2/1974 Bowen ..... 219/121.69
4,356,375 A * 10/1982 Josephy et al. ..... 219/121.68
4,537,809 A * 8/1985 Ang et al. ..... 428/42.2
4,553,693 A * 11/1985 Terajima et al. ..... 229/75
4,762,514 A 8/1988 Yoshida
5,001,325 A * 3/1991 Huizinga ..... 219/121.69
5,054,684 A 10/1991 Farber
5,147,272 A * 9/1992 Richison et al. ..... 493/195
5,201,460 A * 4/1993 Caines ..... 229/103.1
5,229,180 A * 7/1993 Littmann ..... 428/43
5,425,583 A * 6/1995 Wild ..... 383/202
5,744,776 A * 4/1998 Bauer ..... 219/121.7
5,783,266 A * 7/1998 Gehrke ..... 428/34.3
5,804,020 A * 9/1998 Akao et al. ..... 156/251
5,843,363 A * 12/1998 Mitwalsky et al. ..... 264/400
5,868,658 A 2/1999 Wild
5,873,656 A * 2/1999 Arkins et al. ..... 383/202
5,883,356 A * 3/1999 Bauer et al. ..... 219/121.62
6,027,438 A * 2/2000 Frazier et al. ..... 493/196
6,116,782 A * 9/2000 Arkins et al. ..... 383/202

* cited by examiner

*Primary Examiner*—Stephen F. Gerrity
(74) *Attorney, Agent, or Firm*—Edward Lander, Pat. Atty.; Shiboleth, Yisraeli, Roberts, Zisman & Co.

(57) ABSTRACT

There are disclosed methods of making drinking pouches constructed from at least two panels of flexible laminate web material, at least a first panel thereof having a structural layer (21), a barrier layer (22) and a sealant layer (23), the sealant layer having a first thickness. An exemplary method comprises the steps of punching a hole (19) through the first panel, extruding molten sealant onto the sealant layer (24), thereby occluding the hole, colling the first panel and joining the panels together to thereby form a drinking pouch.

11 Claims, 4 Drawing Sheets

DRINK POUCHES AND METHODS FOR PRODUCING THEM

This application is a 371 of PCT/IL01/00338 filed Apr. 12, 2001, which claims benefit of Ser. No. 60/196,355 filed Apr. 12, 2000, this application Ser. No. 09/926,736, claims benefit of Ser. No. 60/261,903 filed Jan. 16, 2001, and claims benefit of Ser. No. 60/277,800 filed Mar. 21, 2001.

FIELD OF THE INVENTION

The present invention relates to a method of making beverage containers. More particularly, the present invention relates to a method for producing flexible, puncturable beverage dispensing pouches having a specific area of weakness designed for ease of puncture with a drinking straw.

BACKGROUND OF THE INVENTION

It is well known in the art of beverage containers to make drink pouches constructed from flexible panels cut from sheets of laminate web materials which are welded together on all but one side, filled with a beverage and then the remaining open side is sealed. In order to drink the contents from such pouches, the user must either tear off a corner of the pouch or insert a drinking straw through the web material into the storage compartment of the pouch. Since the laminate web material may be made with layers including PE (polyethylene) for sealing, Al (aluminum) for air and moisture barrier, and Bonyl (bioriented nylon) for strength, it is no easy matter to pierce it with a common plastic drinking straw, especially for children, the largest segment of the consumer population for such products.

One of the greatest problems is that of opening the hole by means of the straw in a simple, neat manner. Especially in the case of containers which were filled and sealed when the liquid contents were in a hot state, problems arise upon introduction of the straw, since vapour present in the empty head space of the container condenses upon cooling so that there is hardly any air left in the head space. One consequence thereof is that the liquid level may rise and the piercing hole may be below the top of the liquid, resulting in undesirable liquid discharge upon normal opening of the container. Additionally, due to the fact that the front and rear sides of a beverage container are located relatively close to each other, careless piercing may risk piercing the rear side of the beverage container.

Suggested constructions for beverage containers are taught by DE-OS 4140540A1 and U.S. Pat. No. 5,868,658. These patents teach the construction of a bag in which a piercing hole is provided at the time of manufacture by punching through all the layers of the front panel sheeting. The inside of the front side sheeting has a closure sheeting strip (or patch) welded thereto around or on the piercing hole, so that a tight closure is formed. However, the disclosed methods are wasteful and require added welding steps and apparatus to the assembly operation.

A method of making a beverage packaging bag which uses a laser source to facilitate piercing of a straw through the panel is taught in U.S. Pat. No. 4,762,514. The patent teaches providing the panel segment with a pattern of score lines in a portion of the reinforcing outer layer by means of a single application of a laser which is directed at the bag through a mask. The mask shapes the beam to form the desired pattern of score lines.

U.S. Pat. No. 3,790,744 to Bowen, discloses the use of laser energy to provide a straight weakened line in the laminate web materials as to form a tear line across a length of the laminate. However, the depth of the weakened area is intended to be uniform in order to form a straight tear line, not focussed to facilitate puncturing with a straw.

SUMMARY OF THE INVENTION

In order to overcome the problem of having users struggle with the pouch during opening it, the present invention teaches methods of providing a beverage container with a puncture point on the surface of the laminate web material, which enables even a child to easily insert a straw.

According to one exemplary embodiment of the present invention, a sheet of laminate web material having an outer sealant layer, for example of polyethylene, usually dispensed from a roll onto a conveyor belt, is conveyed to a hole-punching station and there is provided with a piercing hole. The hole-punched web material, proceeds downstream from the hole-punching station and there has extruded thereon a layer of molten sealant. The molten layer, which may or may not be from the same material as the sealant layer of the flexible web material, is applied in a coating of substantially uniform thickness along the entire outer surface of the sealant layer. The molten sealant which is layered-on thereby occludes the holes. Thereafter the web is cooled and formed into a pouch, according to known methods.

The method according to this exemplary embodiment allows for a continuous producing of beverage containers. The continuous production flow is not interrupted especially by the application of a closure sheeting, since the closure of said holes is accomplished by extrusion coating while the web is being conveyed in the conveying direction. A further advantage is in saving completely the working step of welding the closure-web so that the only welding needed is to create the pouch at the end. Furthermore, there is no waste of material since the final thickness of the web material is the same as when using unpunched web material. For example, a prior art pouch made from flexible web material that has a sealant layer in the laminate which has a thickness of about 90 microns, to which is added a 40 micron thick heat-sealed patch.

In contrast, a pouch made according to the present invention start with a flexible web material in which the sealant is provided at half the final thickness, i.e. 45 microns. The material is then punched and the entire sealant side is then supplemented with a further 45 microns worth of molten sealant which is applied by extrusion coating. The final product has a sealant layer of about 80–90 microns in thickness, except possibly for the area of the occluded punched hole. Even if the punched hole is completely filled with the molten sealant, which factor can be easily controlled by one skilled in art by varying such conditions as extrusion rates and cooling rates, it still would provide an area of weakness in the wall of the bag which can be pierced by a child with a pointy straw.

Another exemplary embodiment of this invention, which allows for a continuous production of beverage containers is by covering the punched holes by extrusion lamination of two layers of polyethylene, one is a molten adherence layer and the other a solid outer layer. The adherence layer is heated up to a high temperature, which in the material turns into liquid and is then spread uniformly on to the sheet, thereby occluding the entire surface of the front side web. The solid outer layer is placed onto the adherence layer during the production process, using the adherence layer as an adhesive in order to stick the web together. The width of both of the layers together is preferably about 60 microns, thus the width of the entire sealant layer ends up having a thickness similar to that of the finished flexible web material known in the prior art.

A further advantage is in saving completely the working step of welding the closure sheeting strip or patch, therefore the only welding needed is to create the pouch at the end of the process. Furthermore, there is no waste of sealant material since the final thickness of the web material is just the same as the thickness of a web without a hole, produced according to known methods.

A third exemplary embodiment teaches a somewhat different approach for making such pouches which is at once, more economical, more rapid, less expensive and results in pouches which are more reliable and substantially easier for children (and adults) to open. According to this embodiment, instead of punching a hole through the flexible web material and then finishing it with a layer of molten sealant material, the flexible web material starts at the normal finished thickness and a specific area thereof is weakened by using laser to score a mark, comprising at least two intersecting lines on the opposite side of the flexible web material. The point at which the intersection occurs is affected by being passed over with the laser beam more than once to provide a weak spot at the center of the mark. This method provides a point of weakness in the wall of the bag, which can be pierced by a child or adult with a pointy straw.

The present embodiment does not merely use a mask and a single pass of the laser to make a pattern of a number of score marks, all of the same depth on one side of the front side web. Rather, by using multiple passes of a laser to score a mark having an intersection point on the outer structural side of the flexible web material, the laser affects and weakens the sealant material on the side opposite the scoring. The effect on the sealant layer is strongest where the laser lines intersect and provides a focal weakness in the flexible web material. The present embodiment may be practiced by positioning more than one laser on the production line, positioned or programmed to move in order to provide intersecting score lines.

The method according to this embodiment similarly allows for an uninterrupted production flow of beverage containers. The continuous production slow is particularly not interrupted by the application of a closure sheeting, since this production step is eliminated.

A further advantage is in saving completely the working step of welding the closure, so that the only welding needed, is to create the pouch at the end of the process. Furthermore, there is no waste of sealant material, since, as said, the procedure does not involve any use of material, and obviously the final thickness of the web material is just as thick as normally needed.

A BRIEF DESCRIPTION OF THE DRAWINGS

DETAILED DESCRIPTION OF THE EXEMPLARY EMBODIMENTS

Figure 1:
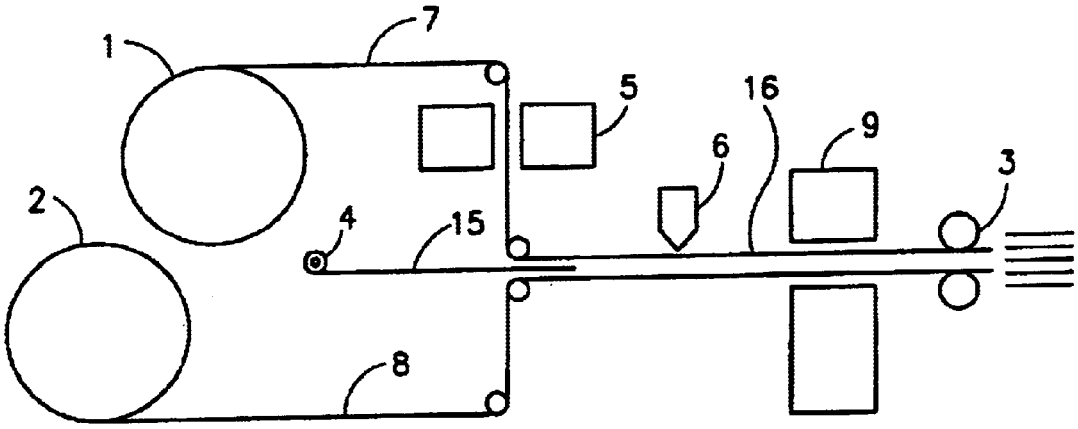
FIG. 1 shows a schematic representation of a side view of apparatus useful for practising the present invention.
Figure 3:
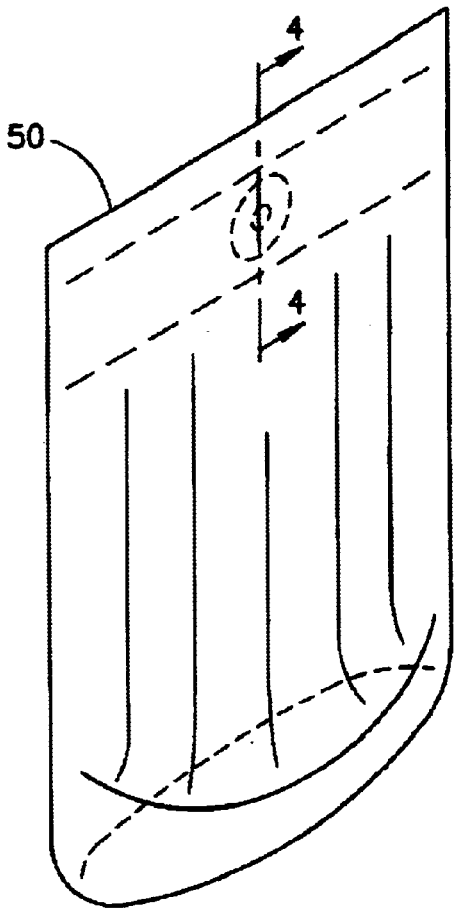
FIG. 3 shows a perspective view of a beverage bag to be produced.
Figure 4:
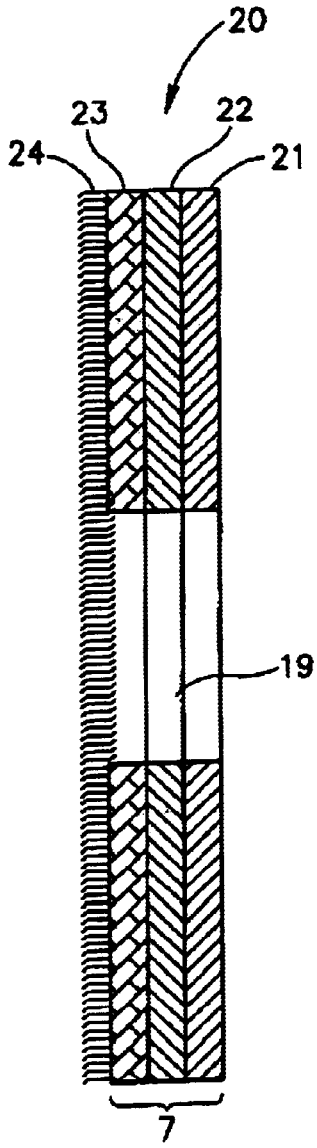
FIG. 4 shows a section along the line 4—4 in FIG. 3.

FIG. 1 shows in a schematic representations an apparatus for producing a beverage container in accordance with the present invention as further illustrated in FIGS. 3 and 4. The sheets of flexible web material necessary for making the front side sheeting web 7, rear side sheeting web 8 and bottom sheeting web 15 of a beverage container 50 are wound onto a front side sheeting supply roll 1 of flexible web material, a bottom sheeting supply roll 4 of flexible web material and a rear side sheeting supply roll 2 of flexible web material. With the aid of conveying rollers 3, the individual sheeting webs dispensed from rolls 1, 2 and 4 are each pulled from their respective supply rolls in a conveying direction. The hole punching station 6 punches at least one piercing hole 19, or a plurality of piercing holes as shown in another exemplary embodiment, in the front side sheeting web 7.

Further downstream of the hole punching station 5, an extrusion station 6 extrudes a molten layer 24 of sealant onto the sealant layer side of the flexible web material. The molten layer 24 is applied in a continuous coating of substantially uniform thickness along the entire surface of the sealant layer 23 with which the front side sheeting web 7 of flexible web material was already coated. The molten layer 24 of sealant which is layered on thereby occludes the hole 19. Thereafter the coated front side sheeting web 16 is cooled and front side sheeting web 7, rear side sheeting web 8 and bottom sheeting web 15 are fed together and passed through a folding and sealing unit 9, which forms and welds them into a pouch 50 which can be filled and then completely sealed, all according to known methods.

Figure 2:
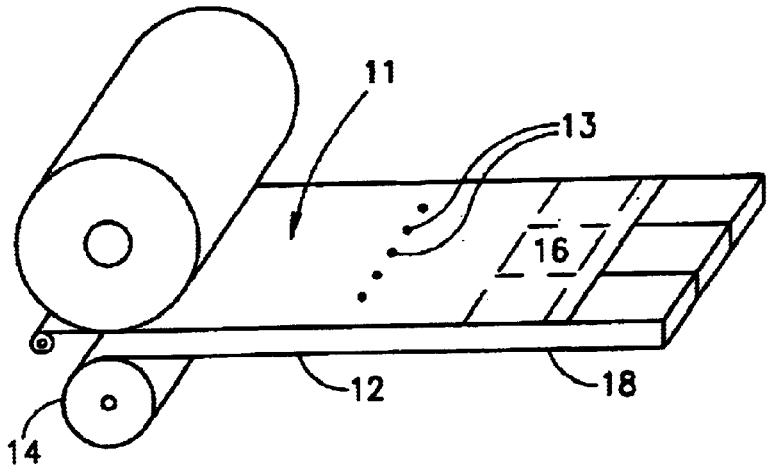
FIG. 2 shows a perspective view of a portion of an embodiment of the apparatus according to the invention.

According to an alternative embodiment of the present invention, it is also possible, as shown in FIG. 2, to provide a plurality of individual beverage containers to be produced, arranged beside each other and perpendicularly to the conveying direction on the front side 11 and rear side 12 sheeting webs respectively.

As can be seen from FIG. 2 the front side sheeting web 11 is fed to the punching unit (not shown) for making the piercing holes 13 correspondingly in intermittent manner. According to the number of containers to be produced a suitable number of holes 13 are made and an identical number of closure sheeting webs 12 are fed from the supply rolls 14 in conveying direction, and run parallel to the front side sheeting web. Then a molten layer is applied in a coating of substantially uniform thickness along the entire surface of the sealant layer with which the front side web 11 is already coated. The coated web 11 is then cut into separate sheeting webs 16 and fed together with back side sheeting webs 18, which are folded and welded into a pouch according to known methods FIG. 4 shows a schematic representation of the front web which includes a web material 20 comprising a structural layer 21, for example from BONyl, an air/moisture barrier layer 22 and a sealant layer 23 is provided at half of the normal final thickness of about 90 microns, i.e. 45 microns, then punched, and the entire sealant layer 23 is then supplemented with a further 45 microns thickness worth of molten sealant 24 which is applied by extrusion coating.

Figure 5:
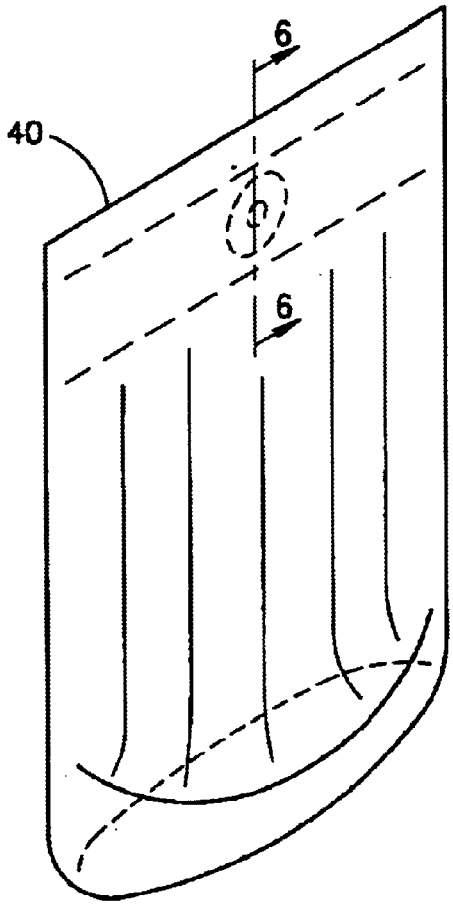
FIG. 5 shows another embodiment of the invention (extrusion lamination)
Figure 6:
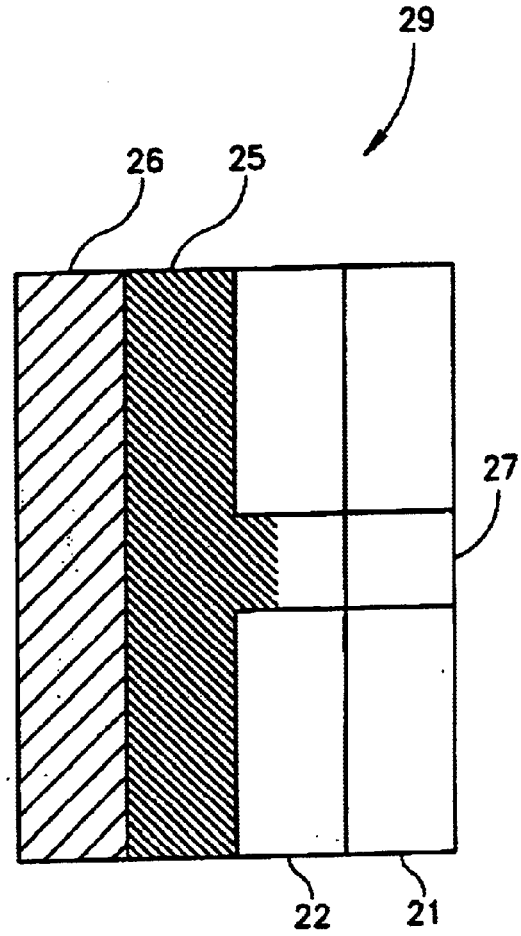
FIG. 6 shows a perspective view of a beverage bag to be produced; according to the laser embodiment.

FIG. 5 shows a schematic representation of the front side web sheeting of an exemplary embodiment utilizing extrusion lamination. One exemplary embodiment of this method begins with a starting web material which comprises a laminate of structural layer 21 and air/moisture barrier layer 22, in which punch hole 23 was previously provided and onto which are applied a molten adherence layer 25 and an outer layer 26. The adherence layer 25 comprises sealant material which is liquefied and spread or extruded uniformly on to the entire surface of the air/moisture barrier layer 22, and thereby occluding the punch hole 23 with a layer of sealant. The outer layer 26, possibly made from polyethylene or some other sealant-type material, is placed onto the adherence layer 25 during the process, using the adherence layer 25 as an adhesive in order to stick the lamina of the web together. It is also contemplated that some adhesive, other than molten sealant, could be used for the adherence layer 25, i.e. the outer layer 26 and adherence layer 25 need not be from the same material.

The width of both of the layers 25, 26 together is about 60 micron, thus the width of the entire front layer stays the same as in other finished embodiments.

In another exemplary embodiment of the present invention, the flexible web material is provided with a weakened point, by use of laser technology as follows. The web 30, intended to be the front side of the bag, passes under a movable laser source 34. The laser beam 35, may be applied using as much as 3 to 4 times the energy used in normal scoring treatment. The laser beam 35 is applied in a pattern of at least two intersecting lines, and is shown in the exemplary embodiment forming a cross-shaped scoring pattern 36 on the structural layer 21 of the front side web sheet 30 of the pouch 40. By adjusting the height of the beam-source, the scored intersection point 37 may be up to 3 to 4 times wider than a score line produced by normal treatment, and thereby more visible and easy to hit with a straw.

The process which is described not only weakens the material by doubly scoring, at least, the area of the structural layer 21 where the beam paths intersect, but moreover, the heat transmitted through structural layer 21 and air/moisture barrier layer 22 to the sealant layer 23 is believed to be sufficient to cause thermally driven local changes in the sealant. These changes may also make it easier for a child to puncture the resulting pouch at that point using a pointy straw.

By manipulating the beam energy and width, one of skill in the art can achieve an intersecting pattern of score lines which are not so deep as to materially affect the structural integrity of the structural layer 21, and yet which apply enough heat energy, especially at the score line intersection point, which is transmitted through to the sealant layer 23 and weakens it sufficiently to permit easier penetration with a drinking straw.

Considering the fact that the laser score is nearly invisible, it is preferable that before scoring with the laser, in order to enable a child to know where to apply the straw end, a dot 31, or other suitable indicia, is made on the outer side of the front side of the bag, and then the laser is applied with the laser beam intersection mark near the the center of the marked spot.

Figure 7:
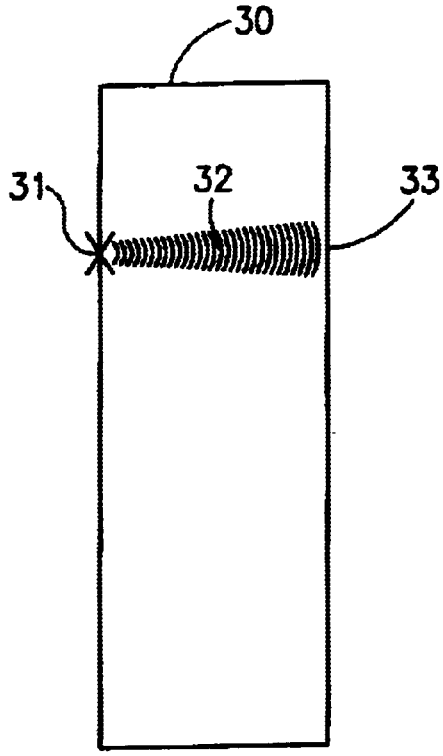
FIG. 7 shows a section taken along line 2—2 in FIG. 5 and looking in the direction of the arrows.
Figure 8:
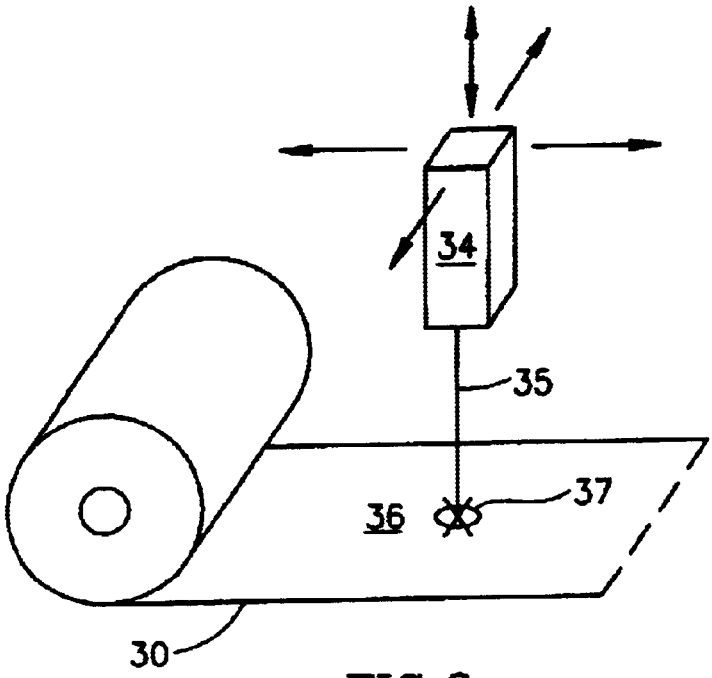
FIG. 8 shows a schematic representation of the process according to the laser embodiment.

FIG. 7 shows a schematic representation of the front side web sheet, in which the punching spot as indicated by dot 31 is weakened by scoring, with a laser, a mark 32 on one side of the front side web, thereby affecting the sealant layer on the other side of the web 33 and weakening what will be the pouch wall at the center of the dot 31.

It should be understood that the above described embodiments of the present invention are merely exemplary and are intended to illustrate the invention without necessarily limiting the scope thereof. It is understood that one of skill in the art may make many modifications and variations to the exemplary embodiments described hereinabove and yet still be within the scope and spirit of the invention as defined in the appended claims.

I claim:

1. A method of making a beverage container constructed from at least two panels of flexible laminate web material, said method comprising:

providing at least a first panel thereof having an outer structural layer, a barrier layer and an inner sealant layer, wherein the inner sealant layer has a thickness, punching a hole through all of said layers of said first panel, and extrusion coating a molten supplemental sealant layer along the entire outer surface of said inner sealant layer, thereby occluding said punched hole and simultaneously providing an integrally-formed specific area of weakness for ease of puncture, wherein said inner sealant layer and said supplemental sealant layer together have a combined thickness of approximately 80–90 microns, and said inner sealant layer is provided at one-half of said combined thickness, cooling said first panel;

joining said at least two panels together to thereby form a drinking pouch.

2. A method of making a beverage container as described in claim 1, wherein said inner sealant layer and said supplemental sealant layer are formed of polyethylene.

3. A method of making a beverage container according to claim 2, wherein the beverage container further comprises a bottom formed from a bottom web, and including the steps of conveying a bottom web in between the at least two panels, and welding the bottom web in part to the at least two panels.

4. A method of making a beverage container according to claim 1, wherein the beverage container further comprises a bottom formed from a bottom web, and including the steps of conveying a bottom web in between the at least two panels, and welding the bottom web in part to the at least two panels.

5. A method of producing a beverage container made out of flexible laminate web material, the method comprising:

providing said flexible laminate web material including an external structural layer, an air/moisture barrier layer and an inner sealant layer, providing a movable laser source for directing a laser beam at said flexible laminate web material for scoring and simultaneously weakening said flexible laminate web material, making a first pass with the movable laser source for directing the laser beam to score a first line in the surface of the external structural layer of said flexible laminate web material and making a second pass with the movable laser source for directing the laser beam to score a second, intersecting line in the surface of the external structural layer of said flexible laminate web material with the point of intersection of the first and second lines providing a puncture point on a surface of said flexible laminate web material and, simultaneously weakening the inner sealant layer of the flexible laminate web material, such that the external structural layer is scored and the inner sealant beneath said puncture point is weakened by heat transmission causing thermal changes therein, by at least double scoring of said puncture point.

6. A method of producing a beverage container in accordance with claim 5, further comprising the step of providing indicia at the point of intersection of the first and second scored lines for marking the puncture point.

7. A drinking bag container made out of flexible laminate web material including an external structural layer, an air/moisture barrier layer and an inner sealant layer, wherein said drinking bag container has a structural focal weakness in the external surface of the web material, said focal weakness comprising the point of intersection of at least two intersecting laser-scored paths, and said focal weakness providing a puncture point for insertion of a drinking straw.

8. A drinking bag container made out of flexible laminate web material according to claim 7, wherein said point of intersection of said laser-scored paths is provided with indicia for marking the puncture point on said web material.

9. A drinking bag container having at least two panels of flexible laminate web material, the first panel thereof having an outer structural layer, a barrier layer and an inner sealant layer; and an integrally-formed specific area of weakness for ease of puncture is provided in said first panel by a hole through all of said layers of said first panel, wherein said hole is occluded by a supplemental sealant layer present upon said hole and present along the entire outer surface of said inner sealant layer;

and wherein said inner sealant layer and said supplemental sealant layer together have a combined thickness of approximately 80–90 microns, and said inner sealant layer is provided at one-half of said combined thickness.

10. A drinking bag container in accordance with claim 9, further comprising a second supplemental sealant layer present upon said first supplemental sealant layer.

11. A method of making a beverage container constructed from at least two panels of flexible laminate web material, said method comprising:

providing at least a first panel thereof having an outer structural layer and a barrier layer:

punching a hole through all of said layers of said first panel, and extrusion laminating a molten adherence layer along the entire outer surface of said first panel, thereby occluding said punched hole and simultaneously providing an integrally-formed specific area of weakness for ease of puncture, placing a supplemental outer layer upon said adherence layer, wherein said adherence layer adheres the layers together;

cooling said first panel;

joining said at least two panels together to thereby form a drinking pouch.

* * * * *